US008297580B2

(12) United States Patent
Kim

(10) Patent No.: US 8,297,580 B2
(45) Date of Patent: Oct. 30, 2012

(54) CORNER PROTECTOR

(76) Inventor: Dong Koo Kim, Palos Verdes, CA (US)

( * ) Notice: Subject to any disclaimer, the term of this patent is extended or adjusted under 35 U.S.C. 154(b) by 254 days.

(21) Appl. No.: 12/845,452

(22) Filed: Jul. 28, 2010

(65) Prior Publication Data

US 2012/0025049 A1 Feb. 2, 2012

(51) Int. Cl.
*A47B 95/00* (2006.01)

(52) U.S. Cl. ..... 248/345.1; 206/586

(58) Field of Classification Search ..... 248/345.1; 40/778, 783; 206/453, 586
See application file for complete search history.

(56) References Cited

U.S. PATENT DOCUMENTS 3,900,156 A * 8/1975 Clark, Jr. ..... 206/586
4,801,018 A * 1/1989 Wilde ..... 206/586
5,149,575 A * 9/1992 Soifer ..... 428/188
5,789,049 A * 8/1998 Randles ..... 428/40.1
6,370,805 B2 * 4/2002 Thompson ..... 40/778
7,350,646 B2 * 4/2008 Durrant ..... 206/586
2002/0056656 A1 * 5/2002 Beliveau ..... 206/453
2005/0144860 A1 * 7/2005 Halstead ..... 52/204.1
2005/0155903 A1 * 7/2005 Myers ..... 206/586
2011/0278199 A1 * 11/2011 Dane et al. ..... 206/586

* cited by examiner

*Primary Examiner* — Ramon Ramirez
(74) *Attorney, Agent, or Firm* — Ardent Law Group, P.C.; Alexander Chang; Anthony King

(57) ABSTRACT

The present embodiment of the subject inventive matter in one embodiment generally comprises of a corner protector containing at least 2 sides and made out of a clear plastic material. The corner protector of the subject inventive matter may also consist of at least one tab to assist in securing the corner protector to the item. Each side of the corner protect of the subject inventive matter may also include protrusions and corresponding receiving grooves that allow corner protector to be securely affixed to the item.

13 Claims, 13 Drawing Sheets

CORNER PROTECTOR

BACKGROUND OF THE INVENTION (1) Field of the Invention

This invention relates to corner protectors, in particular, corner protectors for such products that have edges or corners that need protection from damage.

(2) Background of the Invention

It is very common for edges or corners of items to be damaged, including being scratched, dented or chipped. In particular, items with corners/edges, such as picture frames, mirrors etc. . . . are often easily damaged through shipping, delivery and display. To prevent this, current solutions include the use cardboard to cover the corners. However, cardboard material is often cheap and non-durable leading to the cardboard corner protector to fall off or be easily damaged whereas compromising the protection features of the cardboard corner protector. Another attempt to solve the problem is to use hard plastic (non-see through) as the material for the corner protector. Although this increases the durability of the corner protector, the edges of hard plastic material corner protectors protrude out which causes potential damage to other items that it comes in contact with. In addition, both the cardboard and hard plastic protector both suffer from the same problems which is that they are not clear and block the view of the corners of the item, such as picture frames or mirrors. By blocking the appearance of the corners, this reduces the aesthetic qualities of the item that the corner protectors are on.

In addition, the applicability of the card board or hard plastic type of corner protectors is very limited because it provides only a one-size fits all approach and often times picture frames, mirrors etc. . . . come in a variety of sizes thus making these types of corner protectors inefficient because they are not adjustable or customizable to the actual shape of the items.

All of these limitations are not found by the present embodiment of the subject inventive matter.

BRIEF SUMMARY OF THE INVENTION

Therefore, based upon the above, the inventor has created a corner protector that solves the present problems by providing a corner protector which is clear, durable, easy to securely place on the corners, adjustable, safe for the item and inexpensive to manufacture.

Where a definition or use of a term in a reference, which is incorporated by reference herein, is inconsistent or contrary to the definition of that term provided herein, the definition of that term provided herein applies and the definition of the term in the reference does not apply. The invention may seek to satisfy one or more of the above-mentioned desire. Although the present embodiment of the subject inventive matter may obviate one or more of the above-mentioned desires, it should be understood that some aspects of the invention might not necessarily obviate them.

In these respects, the corner protector according to the present embodiment of the subject inventive matter substantially departs from the conventional concepts and designs of the prior art, and so doing provides a corner protector that is not anticipated, rendered obvious, suggested, or even implied by any of the prior art corner protectors, either alone or in combination thereof.

In view of the foregoing disadvantages inherent in the known types of corner protectors now present in the prior art, the general purpose of the present embodiment of the subject inventive matter, which will be described subsequently in greater detail, is to provide a corner protector that is clear.

Another object of the present embodiment of the subject inventive matter is to provide a corner protector that is durable.

Another object of the present embodiment of the subject inventive matter is to provide a corner protector that is adjustable and customizable depending on the shape of the particular item.

Another object of the present embodiment of the subject inventive matter is to provide a corner protector that can be securely affixed to an item safely without damaging or marring the item itself.

Another object of the present embodiment of the subject inventive matter is to provide a corner protector that can be easily removed without damaging or marring the item itself.

Another object of the present embodiment of the subject inventive matter is to provide a corner protector that is inexpensive to manufacture.

To attain this, the present embodiment of the subject inventive matter in one embodiment generally comprises of a corner protector containing at least 2 sides and made out of a clear plastic material. The corner protector of the subject inventive matter may also consist of at least one tab to assist in securing the corner protector to the item. Each side of the corner protect of the subject inventive matter may also include snap on protrusions that allow corner protector to be securely affixed to the item.

In typical use, the user would place the corner protector on each corner of the item. In this example, the embodiment is a picture frame. However, as noted above, the corner protector of the subject inventive matter can be used on any item with corners/edges that need protection. Once the corner protector of the present invention is positioned on the corner of the item, the user would simply connect side 1 of the corner protector to side 2 of the corner protector. In one embodiment, side 1 of the corner protector would contain at least one protrusion and side 2 of the corner protector would contain corresponding at least one recess to accept such protrusions. The combining of the at least one protrusion to the at least one recess allows both sides to snap together or be combined together forming a secure connection allowing the corner protector to be securely affixed to the picture frame.

In addition, in one embodiment of the corner protector of the present invention, the corner protector will contain at least one tab which can be folded and inserted underneath the front portion of the frame to allow the corner protector more ability to be securely fastened on the picture frame.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplish the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWING(S)

Various other objects, features and attendant advantages of the present embodiment of the subject inventive matter will become fully appreciated as the same becomes better understood when considered in conjunction with the accompanying drawings, in which like reference characters designate the same or similar parts throughout the several views, and wherein.

DETAILED DESCRIPTION OF THE INVENTION

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claims are set forth below in a certain combination, it must be expressly understood that the invention includes other combinations of fewer, more or different elements, which are disclosed herein even when not initially claimed in such combinations.

Figure 1:
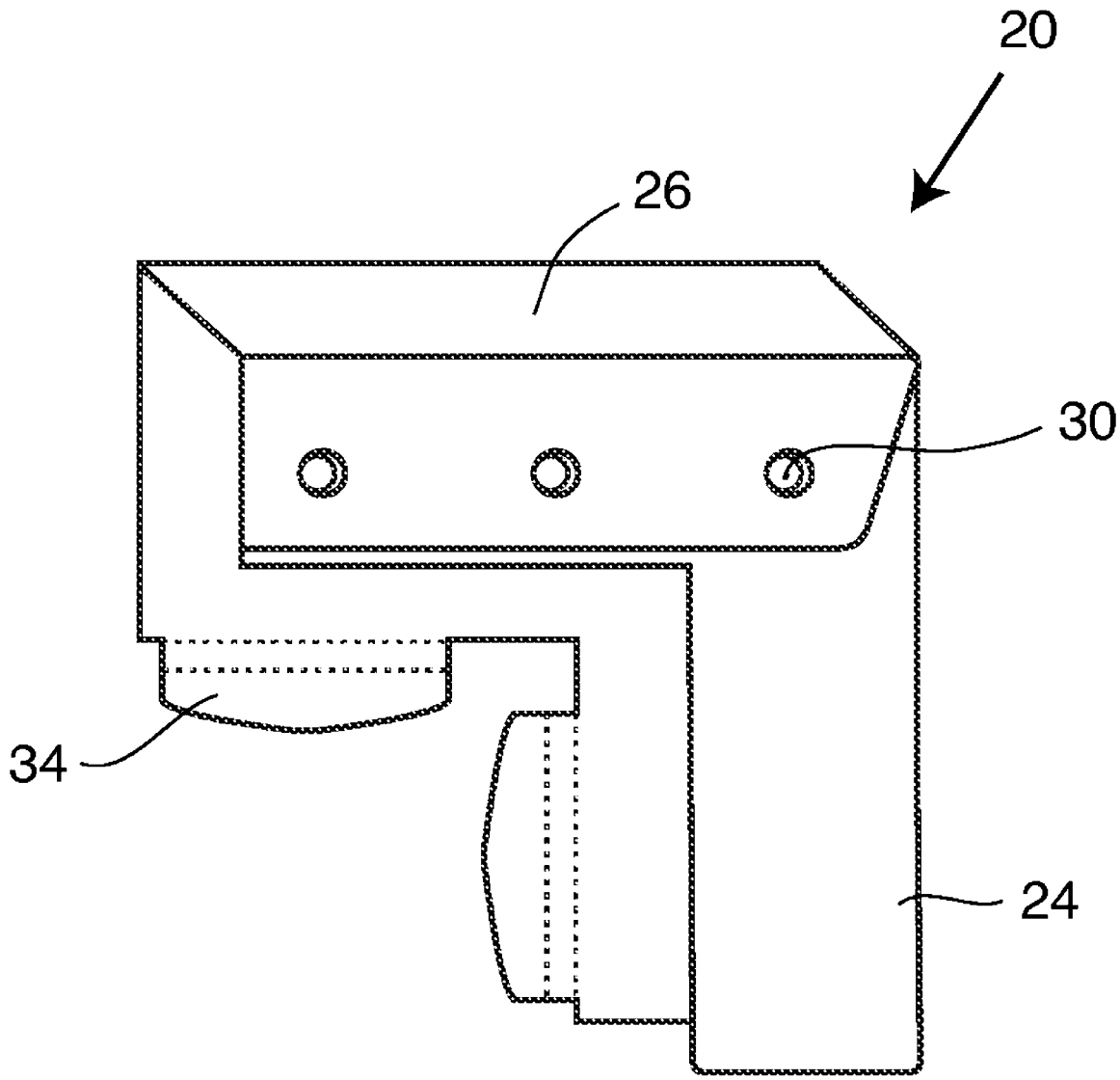
FIG. 1 is a back view of a corner protector of the present invention in a closed position.

Referring now to the drawings, which are provided by way of illustration and example, and wherein like reference numerals designate like or corresponding elements among the several views, there is shown in FIG. 1, a corner protector of the present invention 20 having a L-shaped first side 22, a second side 24 coupled to the first side 22, a top layer 26 coupled to the first side 22, a side layer 28 coupled to the second side 24, wherein the first side 22, second side 24, top layer 26, and side layer 28 are in integral part of a single clear plastic material, and the material having pre-folded lines to distinguish between the first side 22, second side 24, top layer 26, and side layer 28. The corner protector also having at least one protrusion 30 for securely fastening the corner protector to an item. The corner protector of the present invention also containing at least one tab 34 that can be folded to assist in securing the corner protector to an item. In one embodiment, the corner protector is being shown fastened onto a picture frame 36. In the present embodiment, the inventor considers the first side 22 to include the top layer 26 and the protrusion 30 and the second side 24 to include the side layer 28 and the corresponding recess (not shown).

Figure 2:
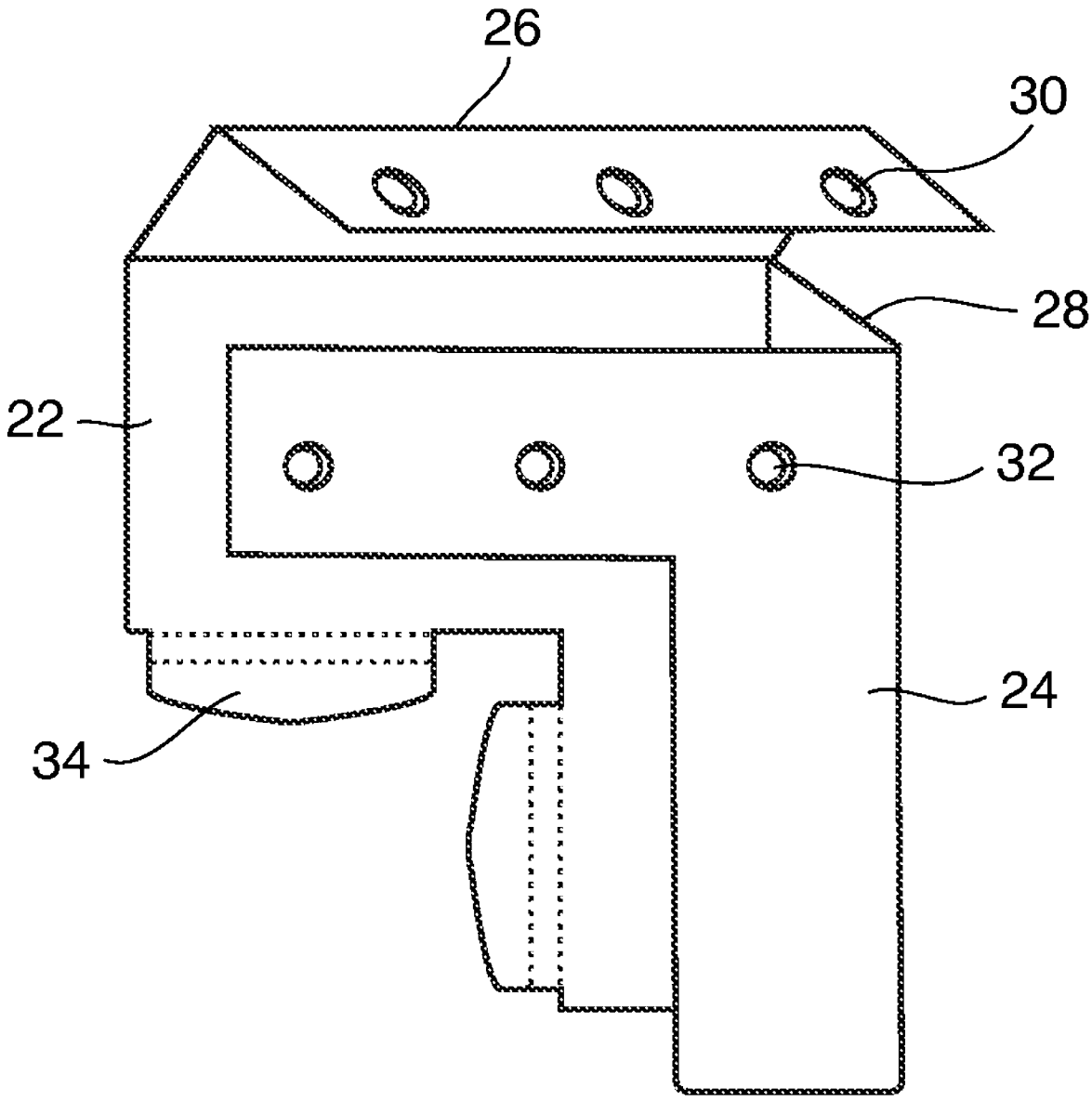
FIG. 2 is a is a back view of a corner protector of the present invention in an opened position.
Figure 3:
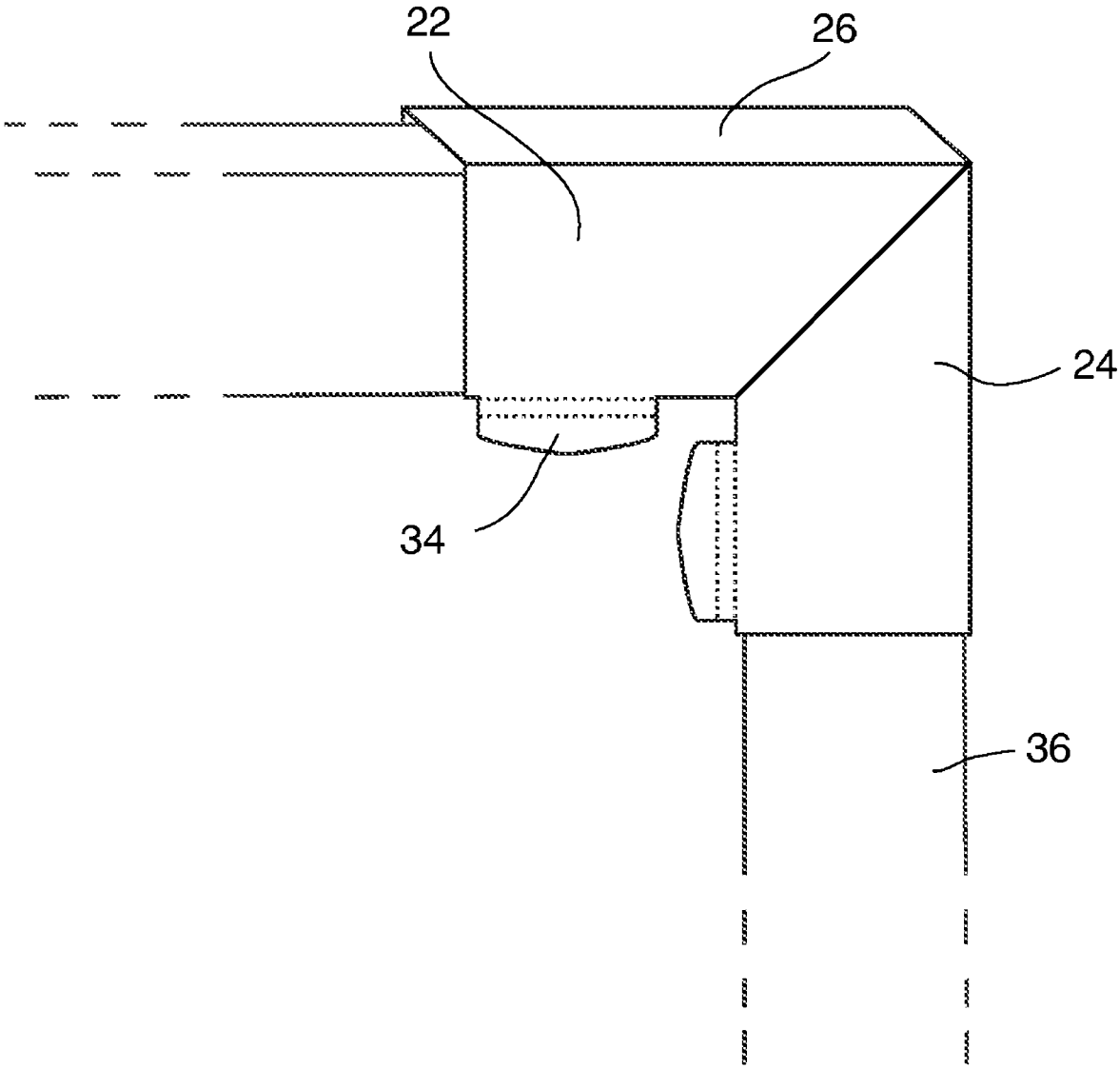
FIG. 3 is a front view of a corner protector of the present invention in a closed position on a picture frame with tabs un-folded.
Figure 4:
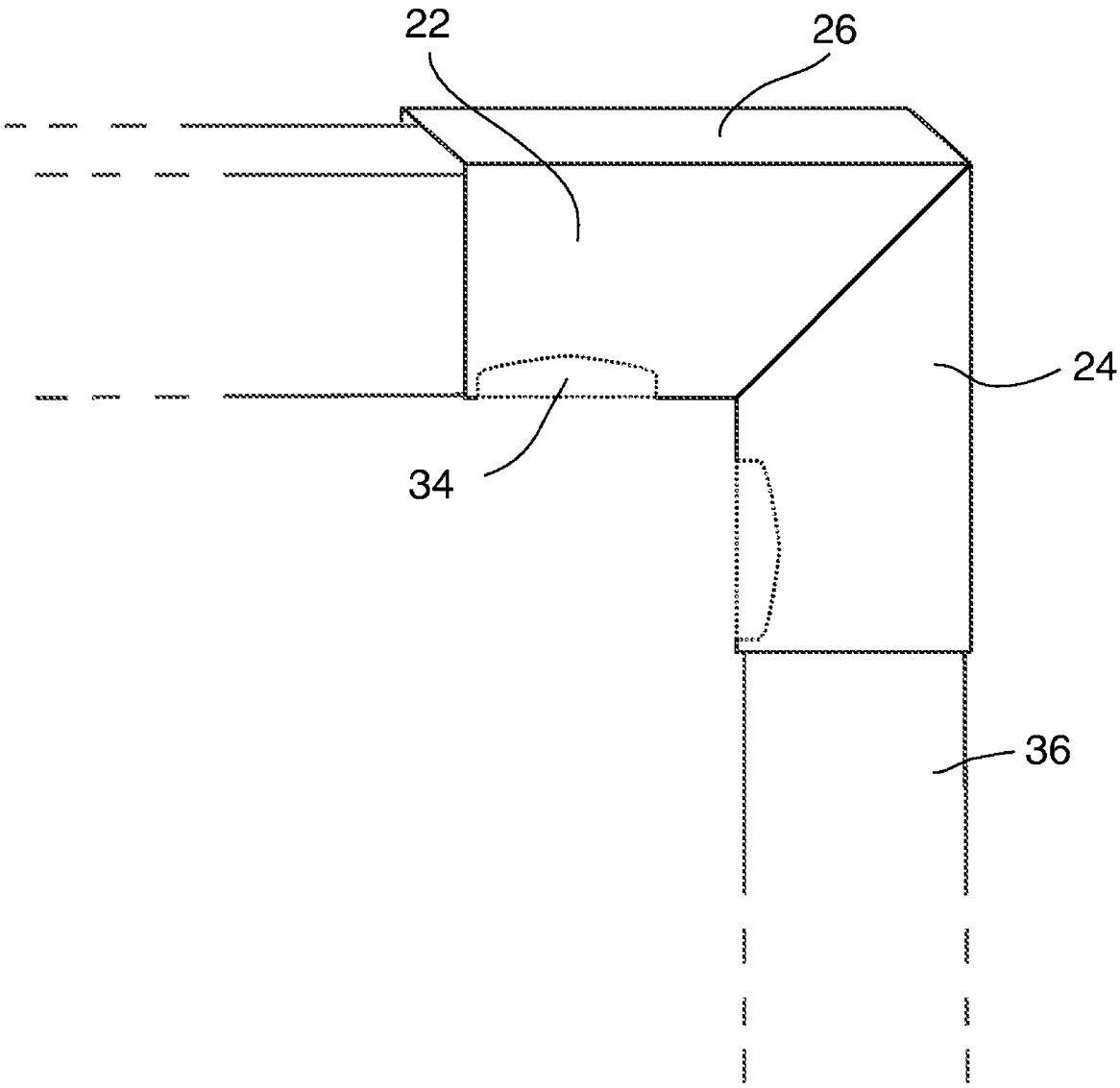
FIG. 4 is a front view of a corner protector of the present invention in a closed position on a picture frame with tabs folded under.

Turning now to the embodiment of FIG. 2, the corner protector of the present invention is shown with at least one recess 32 that corresponds to the at least one protrusion 30, which allows the corner protector to be snapped on to allow easy securing and removal of the corner protector. In other embodiments, the securing mechanism can be other fastening means such as hook and fastener, magnets and/or any other type of similar fastening means. FIG. 3 shows a front view of the corner protector of the present invention on a picture frame 36. As clearly seen, the first side 22 and second side 24 cover the front portion of the corner of the picture frame and wraps around the top and sides to provide full protection of the corners/edges of the picture frame. At least one tab 34 is shown in an un-folded state. FIG. 4 shows at least one tab 34 to be inserted underneath the picture frame border which also assists the corner protector of the present invention to be securely fastened to the picture frame.

Figure 5:
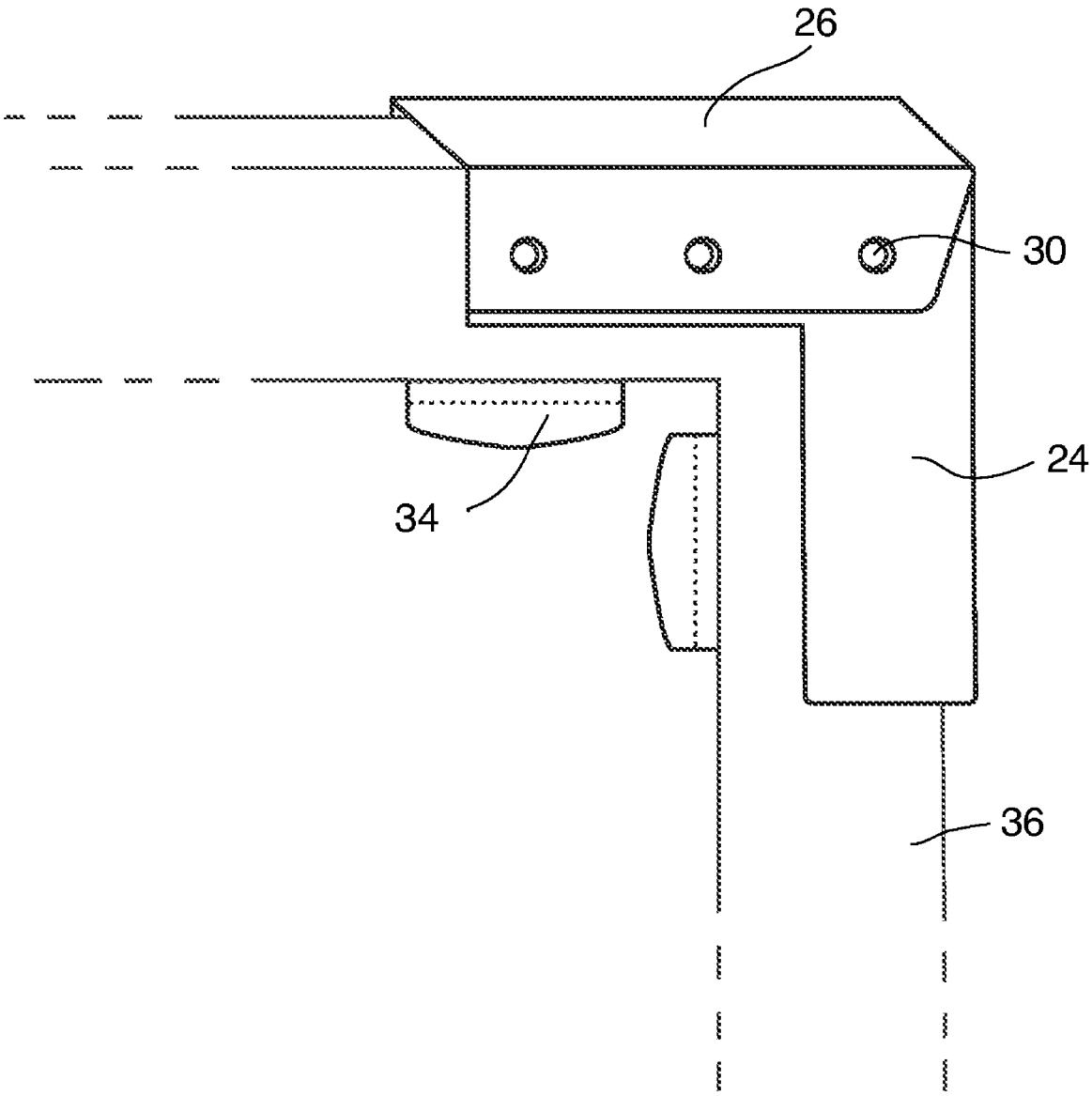
FIG. 5 is a back view of a corner protector of the present invention in a closed position on a picture frame.

Turning now to FIG. 5, the back of the corner protector of the present invention is shown being fastened to the picture frame 36. As clearly seen, at least one protrusion 30 is coupled to at least one corresponding recess (not pictured) which allows the corner protector 20 to be securely attached to the frame protector and also allows for easy removal by simply uncoupling the at least one protrusion 30 from the at least one corresponding recess.

Figure 6:
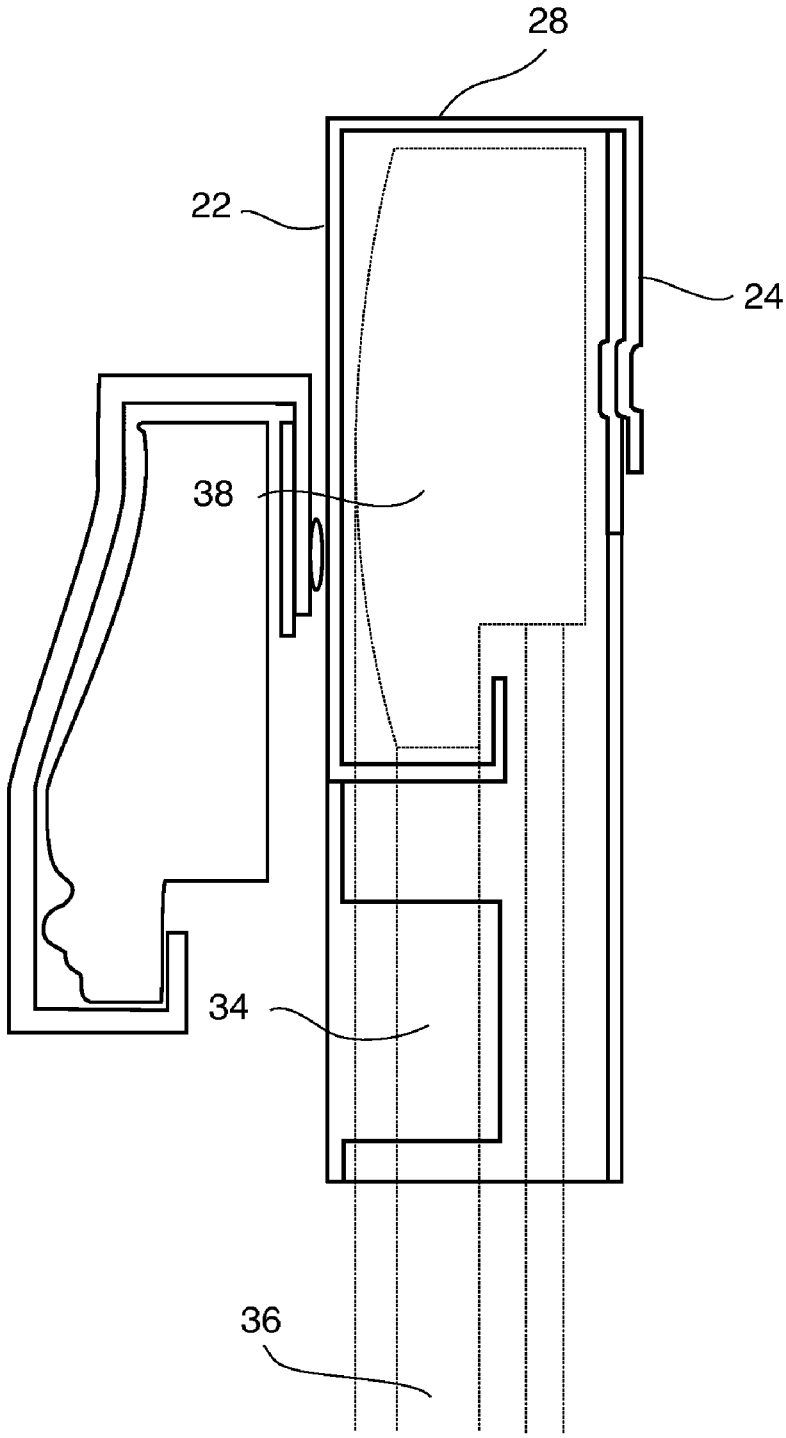
FIG. 6 is a side view of a corner protector of the present invention in a closed position on a picture frame.
Figure 7:
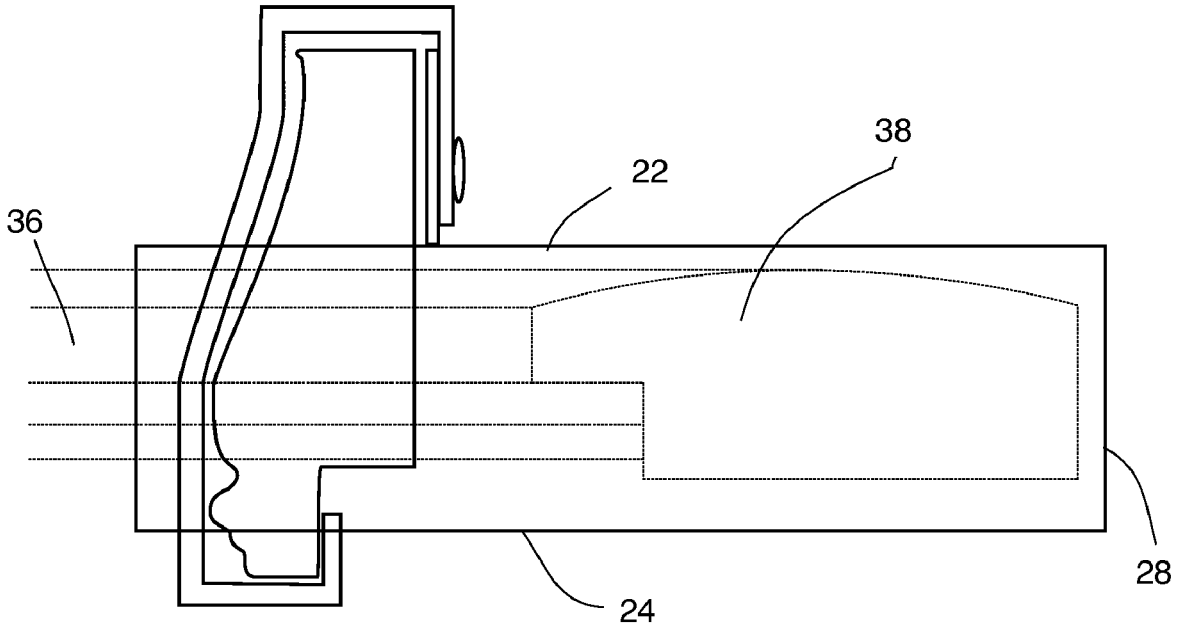
FIG. 7 is a top view of a corner protector of the present invention in a closed position on a picture frame.
Figure 8:
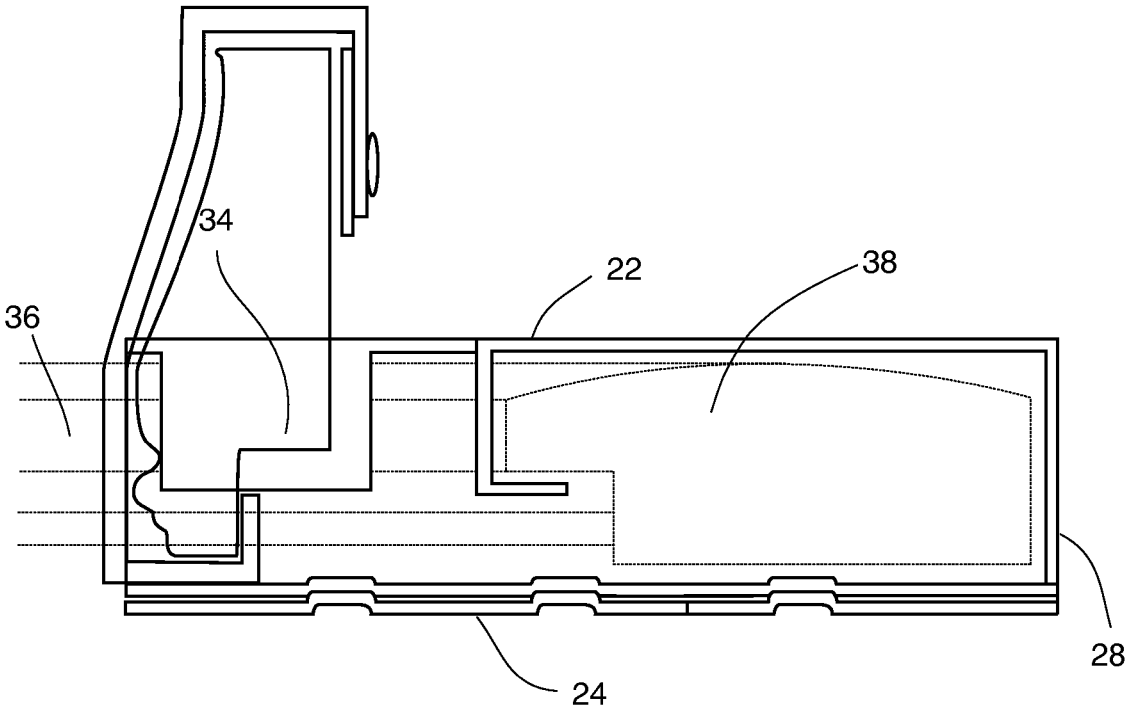
FIG. 8 is a bottom view of a corner protector of the present invention in a closed position on a picture frame.

FIG. 6 depicts a cross-sectional side view of the corner protector of the present invention. As seen in one embodiment, the corner protector of the present invention is securely fastened to the picture frame and it covers the front, back, top and sides of the corner/edge portions of the picture frame 36. FIG. 7 is a top down view of the corner protector of the present invention and FIG. 8 shows a bottom view of the corner protector of the present invention.

Figure 9:
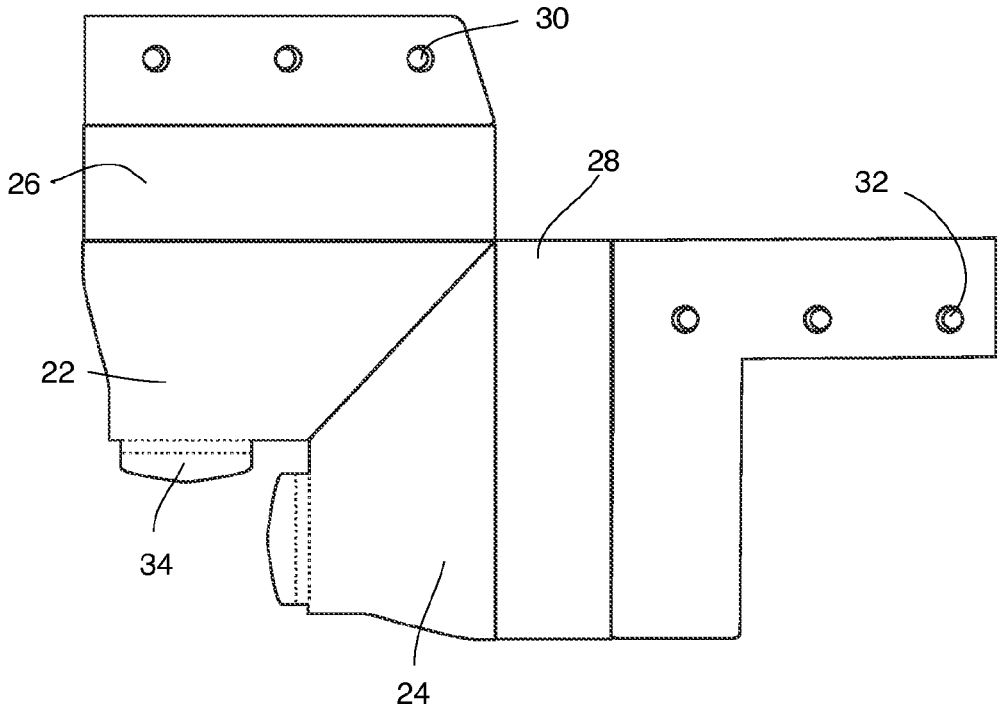
FIG. 9 is a top-down perspective view of a corner protector of the present invention in an unfolded state.

Turning to FIG. 9, the corner protector of the present invention is shown in its un-folded state. In one embodiment, the corner protector of the present invention is made out of a clear plastic-like material which improves the aesthetics and allows the corner-protector to be easily folded and positioned onto the picture frame. In addition, by have the corner protector of the present invention being made from plastic, it allows the costs manufacturing and production of the corner protector of the present invention to remain relatively inexpensive. In addition, the ability of the corner protector of the present invention to be folded flat allows easier packaging and shipment of the corner protector of the present invention.

Figure 10:
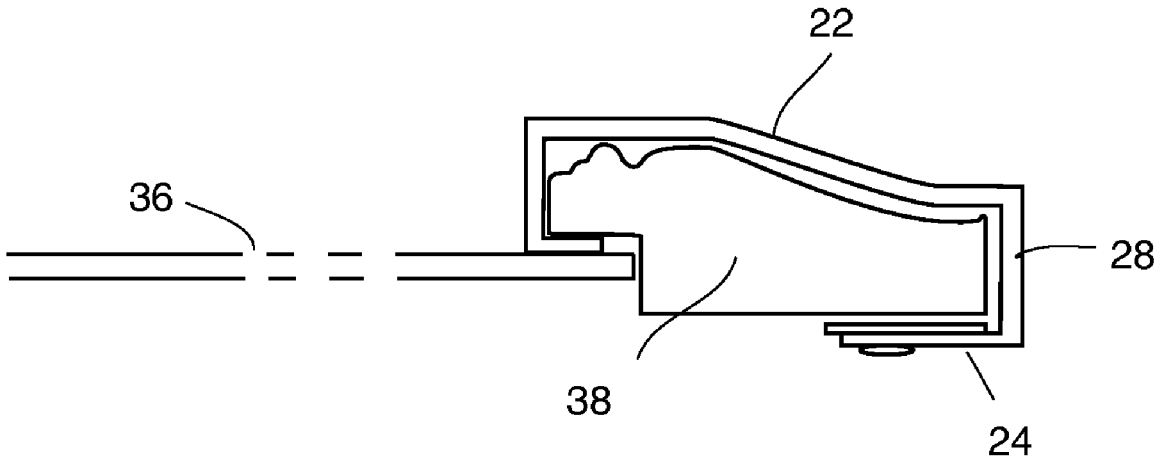
FIG. 10 is a cross-sectional of a corner protector of the present invention in a closed position on a picture frame.

FIG. 10 is a cross-sectional view depicting the ability of the corner protector 20 to be securely fastened to different shapes of picture frames as shown here with the picture frame having molding or border around the picture frame. Many of the previous mentioned prior art lack the ability to be customized to fit a variety of different size frames and molding/borders. As mentioned above, the corner protector of the present invention being made of a clear-plastic like material allows for different versions to be made to fit all variety of shapes and sizes of picture frames at relatively inexpensive costs.

Figure 11:
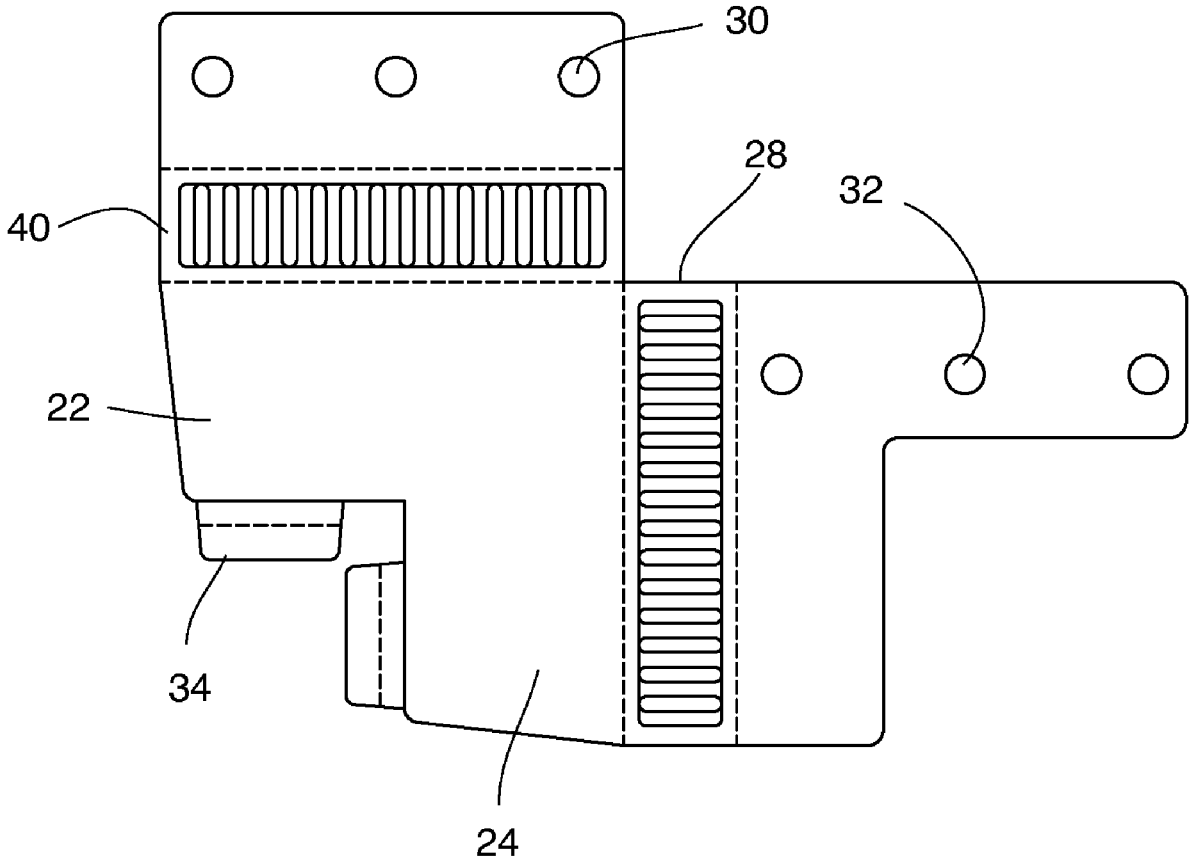
FIG. 11 is a top-down perspective view of another embodiment of a corner protector of the present invention in an unfolded state.
Figure 12:
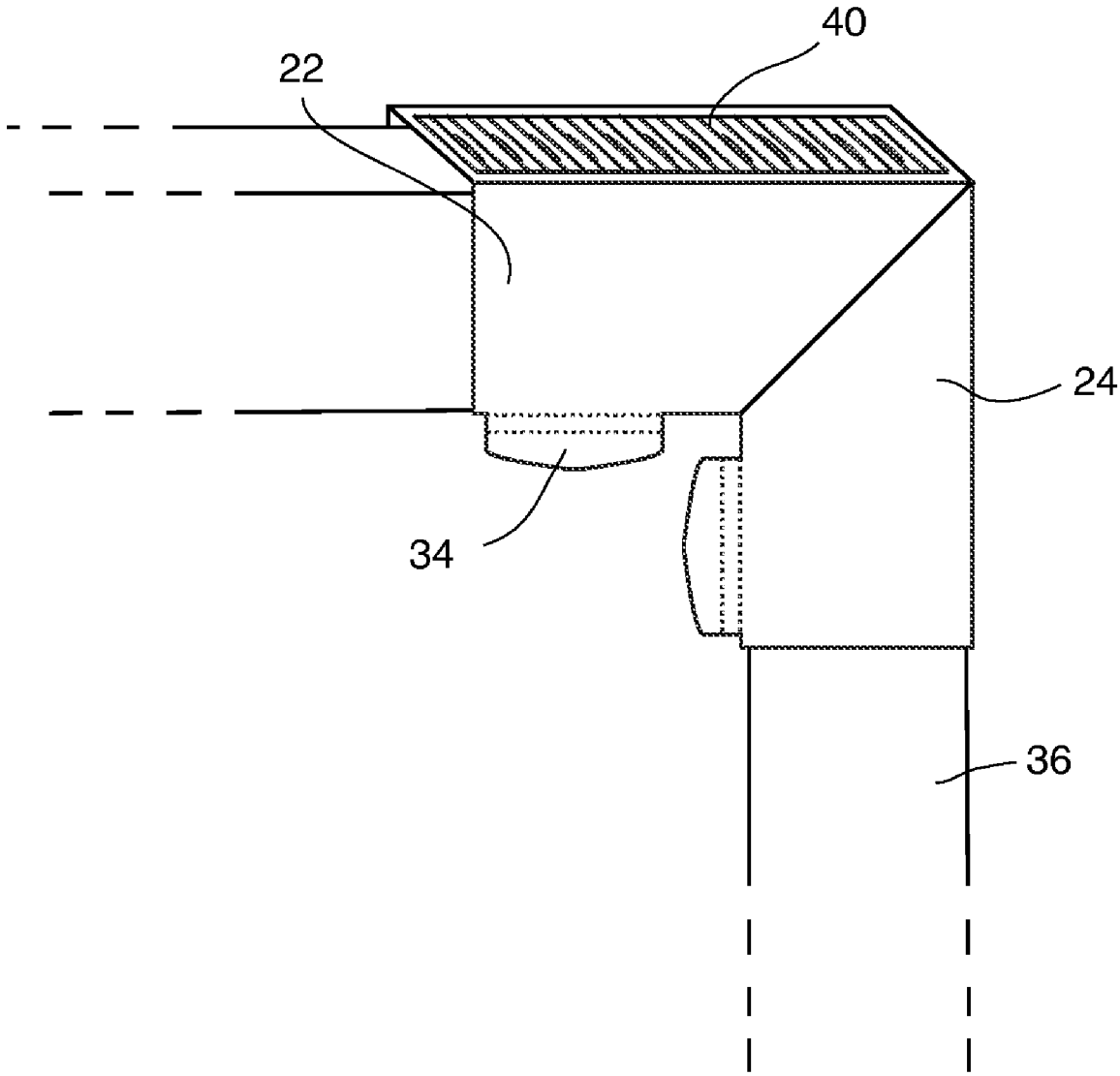
FIG. 12 is a front view of another embodiment of a corner protector of the present invention in a closed position on a picture frame.
Figure 13:
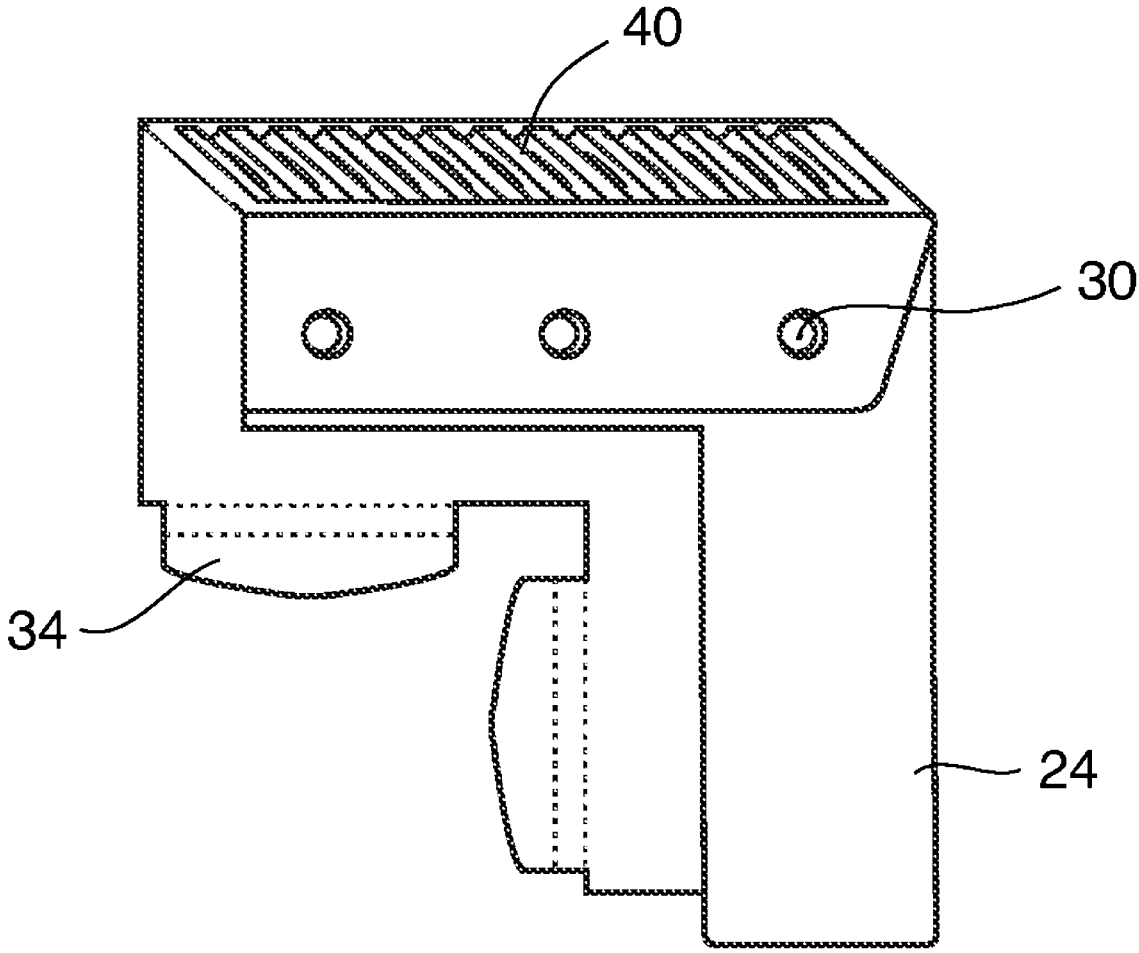
FIG. 13 is a back view of another embodiment of a corner protector of the present invention in a closed position.

Lastly, FIGS. 11, 12 and 13 show another embodiment of the corner protector of the present invention with at least corrugate bumper 40 which provides additional protection by reducing the force of impact when the corner protector of the present invention comes into contact with other things on the top or side of the corner protector which results in the item that is being protected (e.g. picture frame, mirror etc. . . . ) being more insulated and protected from damage.

Thus, specific embodiments and applications of the have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A one-piece corner protector to cover a corner of a photo frame, comprising:

a L-shaped first side;

a second side coupled to said first side;

a top layer coupled to the first side;

a side layer coupled to the second side;

wherein said first side, said second side, said top layer, and said side layer are an integral part of a single clear plastic material, said clear plastic material having pre-folded lines to distinguish between said first side, said second side, said top layer, and said side layer; and coupling means for detachably coupling said top layer to said second side.

2. The one-piece corner protector as recited in claim 1, wherein said coupling means includes at least one protrusion disposed on said top layer and at least one corresponding recess disposed on said second side.

3. The one-piece corner protector as recited in claim 2, wherein said first side of the protector and said front side of the frame body have corresponding contours.

4. The one-piece corner protector as recited in claim 1 wherein said first side contains at least one foldable tab.

5. The one-piece corner protector as recited in claim 1, wherein at least one of said side layer or said top layer has a corrugated-like bumper.

6. A frame protector for picture frames, comprising:

a L-shaped first side having a foldable tab;

a top layer coupled to said L-shaped first side;

a second side coupled to said first side;

a side layer coupled to said second side;

coupling means for detachably coupling said first side to said second side; and wherein said first side, top layer, side layer, and second are integral part of a single piece of clear material.

7. The frame protector as recited in claim 6, wherein said coupling means is a set of corresponding protrusion and recess.

8. The frame protector as recited in claim 7 wherein said frame protector is made from plastic.

9. The frame protector as recited in claim 6 wherein at least one of said top layer and side layer has one corrugated-like bumper.

10. A method of protecting corners of a picture frame, the method comprising:

using a one-piece plastic apparatus having a L-shaped first side and a second side, a side layer and a top layer, wherein said top layer has an extension piece containing at least one protrusion and wherein said second side containing at least one corresponding recess to accept said at least one protrusion;

providing a foldable tab attached to said first side; and inserting said foldable tab underneath a picture frame border.

11. The method as recited in claim 10, wherein said one-piece plastic apparatus is transparent to allow the picture frame to be seen underneath said one-piece plastic apparatus.

12. The method as recited in claim 10, further comprising providing pre-folded lines in said apparatus to distinguish between said first side, said second side, said top layer, said side layer.

13. The method as recited in claim 10, further providing at least one corrugated-like bumper on at least one of said top layer and said side layer.

* * * * *